United States Patent [19]

Yajima et al.

[11] 4,147,538

[45] Apr. 3, 1979

[54] COBALT OR COBALT ALLOY COMPOSITE MATERIALS REINFORCED WITH CONTINUOUS SILICON CARBIDE FIBERS AND A METHOD FOR PRODUCING THE SAME

[75] Inventors: Seishi Yajima; Hideo Kayano, both of Ohnuki; Chiaki Asada; Makoto Saito, both of Nagoya, all of Japan

[73] Assignee: The Research Institute for Iron, Steel and other Metals of the Tohoku University, Sendai, Japan

[21] Appl. No.: 761,168

[22] Filed: Jan. 21, 1977

[30] Foreign Application Priority Data

Jan. 29, 1976 [JP] Japan ..... 51-7877

[51] Int. Cl.[2] ..... B22F 3/00

[52] U.S. Cl. ..... 75/229; 75/DIG. 1; 75/236; 75/241; 75/242

[58] Field of Search ..... 75/DIG. 1, 229, 236, 75/241, 242

[56] References Cited

U.S. PATENT DOCUMENTS

| | | | |
|---|---|---|---|
| 3,364,975 | 1/1968 | Gruber | 75/DIG. 1 |
| 3,507,632 | 4/1970 | Swoboda et al. | 75/229 |

FOREIGN PATENT DOCUMENTS

| | | | |
|---|---|---|---|
| 2236078 | 3/1974 | Fed. Rep. of Germany. | |
| 1582823 | 10/1969 | France | 75/229 |

*Primary Examiner*—Brooks H. Hunt

*Attorney, Agent, or Firm*—Ladas, Parry, Von Gehr, Goldsmith & Deschamps

[57] ABSTRACT

Cobalt or cobalt alloy composite materials reinforced with continuous silicon carbide fibers, which have a high tensile strength, a low elongation, a high Young modulus and a high tensile strength at a high temperature, are produced by filling spaces in piles of the continuous silicon carbide fibers containing 0.01%–30% by weight of free carbon with melted or powdery metallic cobalt or cobalt alloy and integrating the said fibers with the said metal.

2 Claims, 8 Drawing Figures

COBALT OR COBALT ALLOY COMPOSITE MATERIALS REINFORCED WITH CONTINUOUS SILICON CARBIDE FIBERS AND A METHOD FOR PRODUCING THE SAME

BACKGROUND OF THE INVENTION

1. Field of the Invention

The present invention relates to cobalt or cobalt alloy composite materials reinforced with silicon carbide fibers and a method for producing the same. Recently space development and atomic energy development proceed and therefore materials capable of resisting a super high temperature are demanded and it has been attempted to reinforce metals with fibers and the production of materials which can be used under severe circumstances has been attempted by reinforcing metals with alumina fibers, boron fibers, tungsten fibers, carbon fibers and the like and the materials capable of being practically used have been used in part.

2. Description of the Prior Art

Heretofore, the study relating to metal composite materials reinforced with silicon carbide fibers has been made by using silicon carbide whiskers and as the metals to be reinforced with said whiskers, aluminum, iron, nickel, beryllium, cobalt, titanium and the like have been taken into account. Among them, cobalt is hopeful as a base material of heat resistant and oxidation resistant materials. However, in the cobalt composite material reinforced with silicon carbide whiskers, cobalt, when heated at a high temperature higher than 700° C. for a long time, reacts with silicon carbide and the shear strength between silicon carbide and cobalt in the above described composite material lowers. Accordingly, the cobalt composite material reinforced with silicon carbide whiskers has not yet been practically used.

DETAILED EXPLANATION OF THE INVENTION

The present invention is to provide a method for producing practically useful cobalt or cobalt alloy composite materials reinforced with the silicon carbide fibers, which have a high tensile strength at room temperature and a high temperature and a high Young modulus, by integrating the silicon carbide fibers into cobalt metal or cobalt alloy.

It has been found that in a combination of the silicon carbide fibers containing 0.01%–30% by weight of free carbon and metallic cobalt or cobalt alloy, the free carbon preferentially and easily reacts with cobalt metal at high temperatures to form carbides, so that it is prevented that carbon evolved through decomposition of silicon carbide diffuses into cobalt metal and therefore the decomposition reaction of silicon carbide hardly occurs and silicon carbide does not react with cobalt and the carbide composed of the free carbon and cobalt metal improves the wettability or bonding ability of silicon carbide fibers with cobalt metal matrix, so that the shear strength between the fibers and the metal matrix becomes high. It has been noticed that the silicon carbide fibers containing not less than 0.01% of free carbon and cobalt are formed into a stable composite material and the present invention has been accomplished.

The silicon carbide fibers containing 0.01%–30% by weight of free carbon to be used for the production of the composite materials of the present invention are produced by the method as disclosed in U.S. patent application Ser. No. 677,960.

The silicon carbide fibers containing 0.01%–30% by weight of free carbon is used in the production of the cobalt composite materials reinforced with the silicon carbide fibers, because when free carbon is less than 0.01% by weight, an amount of free carbon diffused into cobalt metal matrix from the silicon carbide fibers is small, so that it is impossible to prevent the reaction of the silicon carbide fibers with cobalt and the shear strength between the said fibers and the metal matrix lowers and therefore the function in which the silicon carbide fibers and cobalt metal matrix cooperate to develop the strength of the composite material, cannot be obtained.

In the present invention, when the silicon carbide fibers containing 2–20% by weight of free carbon are used, the best result can be obtained.

Figure 1:
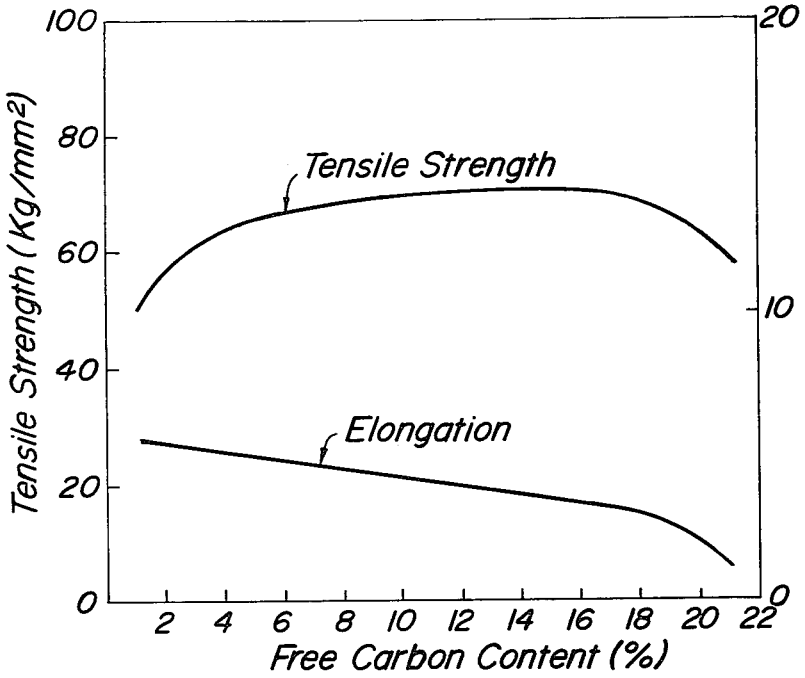
FIG. 1 is a graphical representation showing a relation among an amount of free carbon contained in the silicon carbide fibers and the elongation and tensile strength of cobalt or cobalt alloy composite materials reinforced with the silicon carbide fibers.

A relation between the tensile strength and elongation of the cobalt composite materials obtained by using the silicon carbide fibers containing different amounts of free carbon and the amount of free carbon is shown in FIG. 1. As seen FIG. 1, the tensile strength of the composite materials is improved with increase of the amount of free carbon when the said amount is about 14%, the tensile strength becomes constant and over about 18%, the tensile strength decreases, and when said amount exceeds 20%, the effect required as the composite material is lost. On the other hand, when said amount is less than 2%, the effect required as the composite material is not obtained.

The elongation of the composite material lowers as the amount of free carbon increases and over 20%, the elongation becomes very small. Accordingly, the use of the silicon carbide fibers containing 2–20% by weight of free carbon is advantageous.

Figure 2:
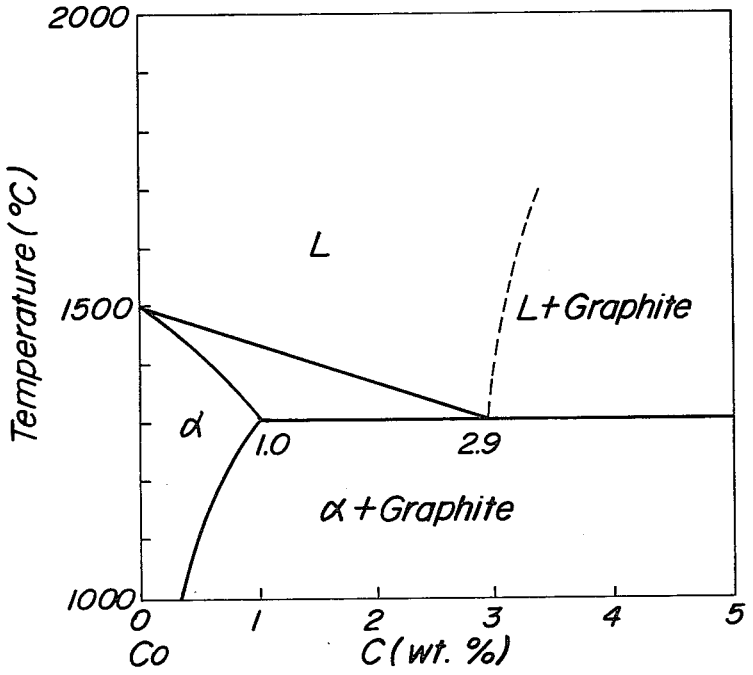
FIG. 2 shows a phase diagram of cobalt and carbon.

The reason why the tensile strength of the cobalt composite material reinforced with the silicon carbide fibers is improved with increase in the amount of free carbon is as follows. As shown in the phase diagram of Co-C system in FIG. 2, the free carbon in the silicon carbide fibers diffuses into cobalt metal at a high temperature to form a solid solution and when cooling, a part of the above described carbon becomes the carbide, which is deposited on the surface of the silicon carbide fiber and the other part is dissolved in cobalt metal to form a solid solution. The above described deposited carbide bonds the silicon carbide fiber with cobalt metal matrix to increase the tensile strength of the composite material and further the carbon in the form of solid solution in cobalt metal increases the hardness of the metal matrix to increase the tensile strength of the composite material.

The diffusion of the above described free carbon into cobalt is more preferential and easier than that of carbon formed by the decomposition of silicon carbide, so that the concentration of carbon in cobalt due to the diffusion of the above described free carbon increases and the diffusion speed of carbon formed by the decomposition of silicon carbide is lowered, so that the reaction of silicon carbide with cobalt metal is prevented and the decrease of the shear strength resulting from the reaction of silicon carbide with cobalt as seen in the cobalt composite material reinforced with silicon carbide whiskers composed of only silicon carbide does not occur. Furthermore, the silicon carbide fibers and cobalt metal slightly react on the boundary, so that the wettability of the fiber and the metal matrix becomes better and by addition of such a wettability to the improved wettability due to the formation of the carbide, the shear strength is increased and the tensile strength of the composite material made through the present invention is increased. However, when the amount of free carbon in the silicon carbide fibers increases, an amount of the carbide formed becomes larger and further an amount of carbon in the form of solid solution in cobalt metal matrix increases, so that the elongation becomes small.

Figure 3:
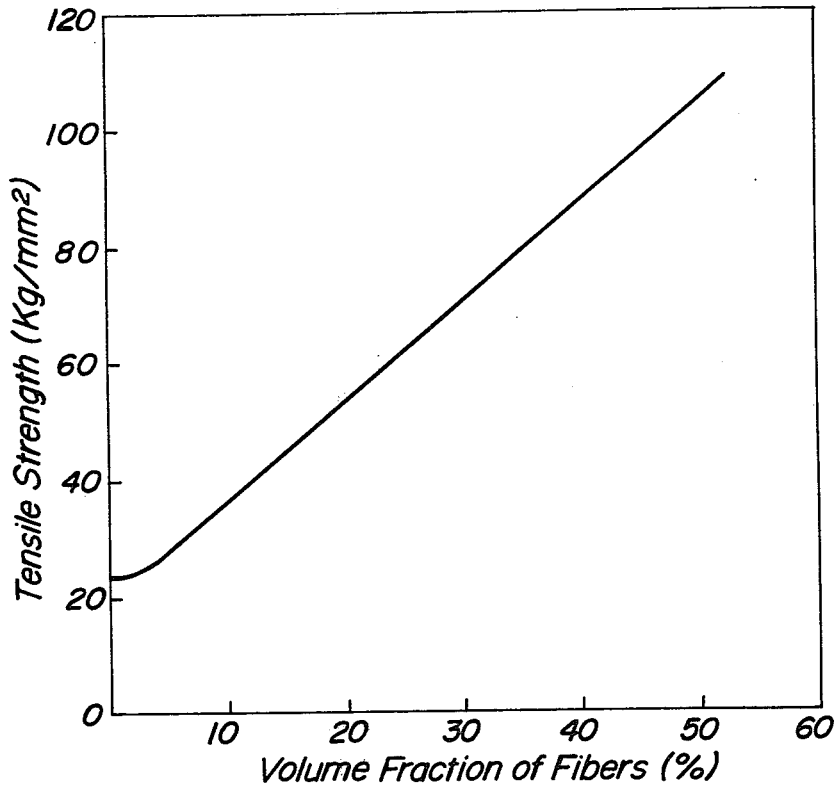
FIG. 3 is a graphical representation showing a relation between the volume fraction of the silicon carbide fibers in the cobalt composite materials reinforced with the silicon carbide fibers containing 8% by weight of free carbon and the tensile strength.

The tensile strength, elongation and Young modulus of the cobalt composite materials reinforced with the silicon carbide fibers made through the present invention vary depending upon the volume percentage of the silicon carbide fibers in the composite material. Namely, as shown in FIG. 3, the tensile strength of the cobalt composite materials reinforced with the silicon carbide fibers in which the volume fraction of the silicon carbide fibers containing 8% by weight of free carbon varies, increases as the said volume fraction becomes larger and when said volume fraction is 50%, the tensile strength becomes about 4 times as high as the tensile strength of cobalt.

Figure 4:
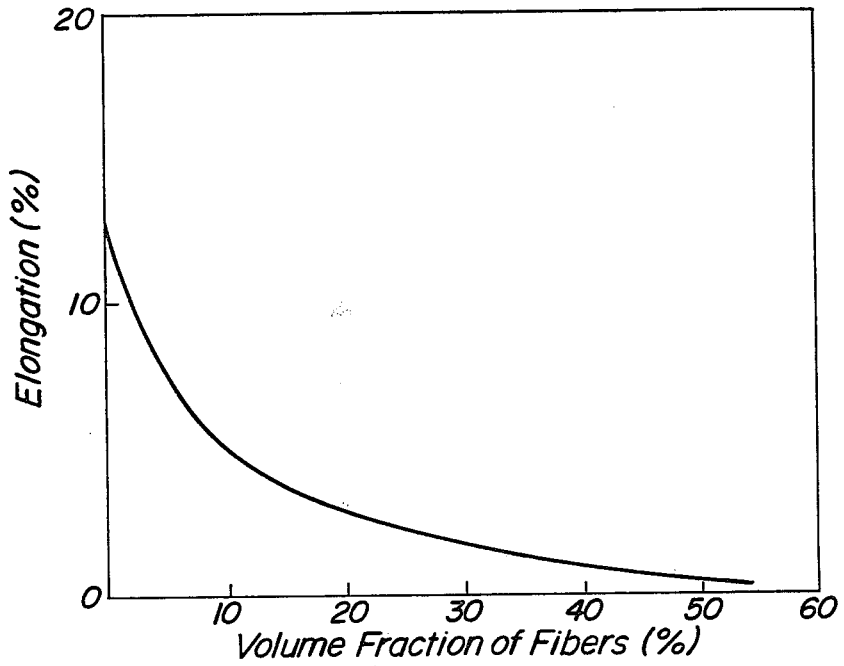
FIG. 4 is a graphical representation showing a relation between the volume fraction of the fibers in the cobalt composite materials reinforced with the silicon carbide fibers containing 8% by weight of free carbon and the elongation.
Figure 5:
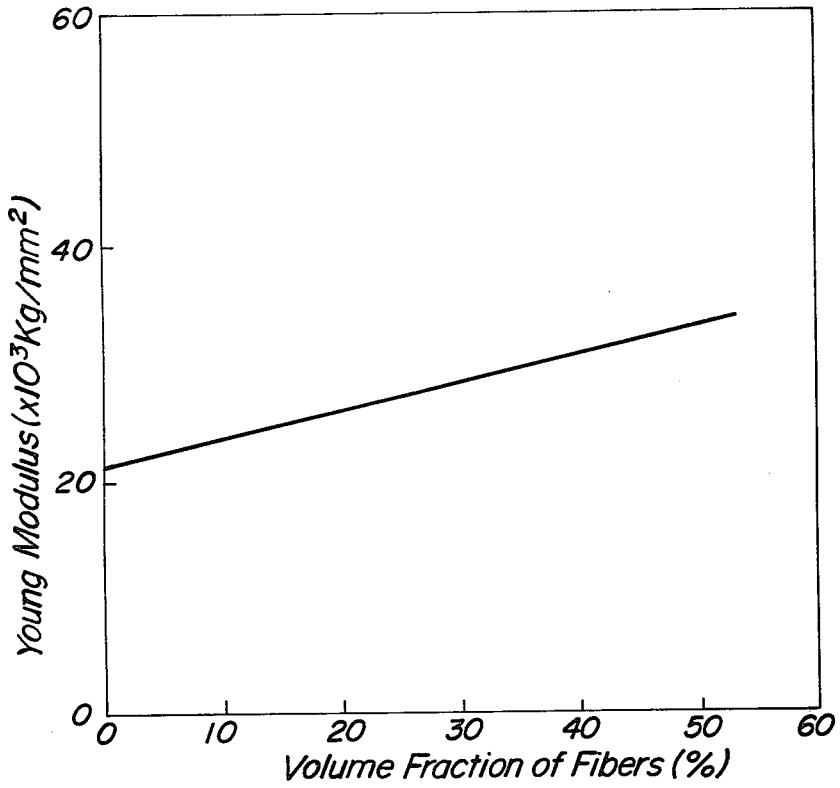
FIG. 5 is a graphical representation showing a relation between the volume fraction of the fibers in the cobalt composite materials reinforced with silicon carbide fibers containing 8% by weight of free carbon and the Young modulus.

However, the elongation of the above described composite materials, as shown in FIG. 4, becomes smaller, as the volume fraction increases and when the volume fraction exceeds 50%, the composite material has no elongation. When the volume fraction of the silicon carbide fibers is less than 2%, the tensile strength of the composite material is not substantially different from that of cobalt as shown in FIG. 3.

The Young modulus of the cobalt composite materials reinforced with the silicon carbide fibers increases as the volume fraction of the fibers becomes larger and when said volume fraction is 50%, Young modulus becomes about 1.5 times as large as that of cobalt.

Figure 6:
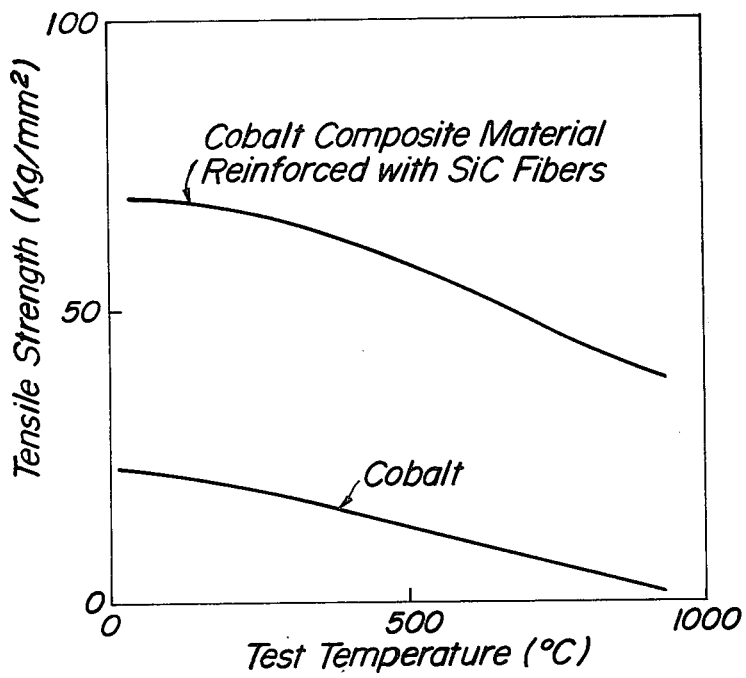
FIG. 6 is a graphical representation showing a relation between the tensile strength of the cobalt composite material reinforced with silicon carbide fibers containing 8% by weight of free carbon and cobalt and the test temperature.

The cobalt composite materials made through the present invention have an excellent tensile strength even at high temperatures and as shown in FIG. 6, although the tensile strength of the cobalt composite material made through the present invention, which contains the silicon carbide fibers having 10% of free carbon in a volume fraction of 35%, at high temperatures under argon atmosphere decreases, as the temperature becomes higher, the decrease rate is smaller than that of cobalt and even at 900° C., the tensile strength is about 40 kg/mm$^2$, accordingly the cobalt composite materials made through the present invention show an excellent property at high temperatures.

Figure 7:
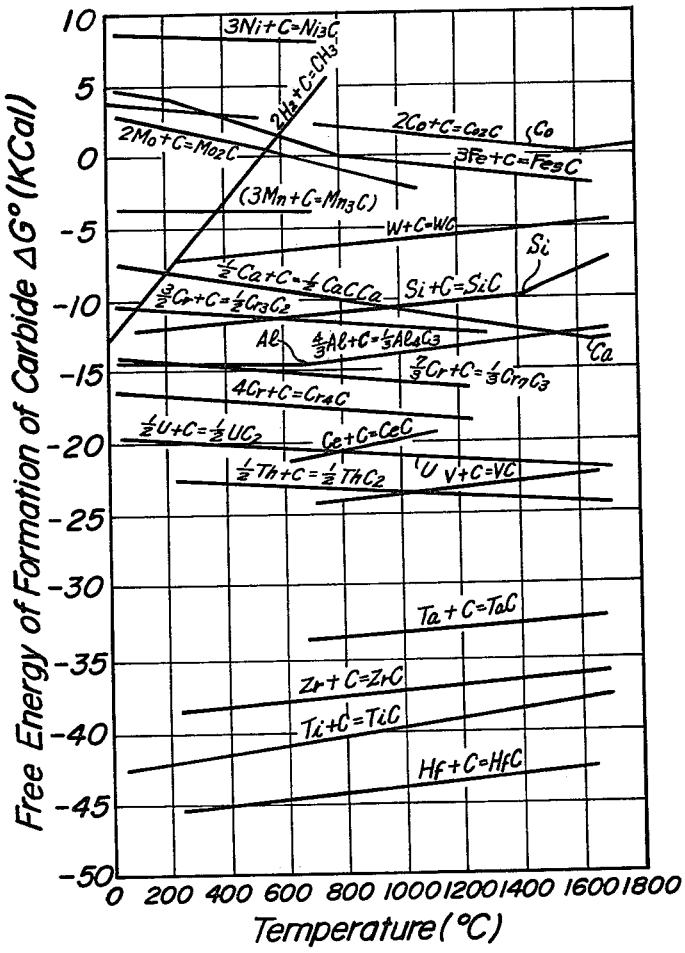
FIG. 7 is a graphical representation showing free energy of formation of carbide of various metals.

The variation of free energy of formation of carbide of various metals in the reaction with carbon in the cobalt composite materials according to the present invention is shown in FIG. 7. As seen from FIG. 7, it is possible to form the composite materials reinforced with the silicon carbide fibers by adding elements having negative values to the metal matrix. Such elements capable of being added include iron, copper, chromium, nickel, molybdenum, manganese, silicon, niobium, titanium, aluminum, iron, tungsten, vanadium, tantalum, zirconium, hafnium, calcium, boron, rhenium, uranium and the like. These elements form stable carbides on the surface of the fiber at a high temperature, in the silicon carbide fibers containing at least 0.01% by weight of free carbon.

The carbides formed on the surface of the fiber have a function of a protecting film by which the decomposition of silicon carbide due to the reaction with cobalt is prevented and further a function which bonds the fiber the metal matrix. Accordingly, it is advantageous for production of the composite materials that the cobalt alloy matrixes obtained by adding the above described various elements to cobalt are used as the metal matrix.

When the cobalt alloy matrixes added with at least one of the above described various elements which easily form the carbides are used as the metal matrix, iron or copper which is considered to readily react with silicon carbide, may be added to the above described alloys in an amount of up to 40% by weight, because the silicon carbide fibers are protected by the carbide. However, when more than 40% of iron or copper is added, the reaction of iron or copper with silicon carbide occurs and the shear strength between the fiber and the metal matrix lowers, so that such an amount is not preferable.

An amount of chromium added is 0–30% by weight, because when such an amount exceeds 30%, the creep rupture strength at high temperatures lowers.

An amount of nickel added is 0–40% by weight, because when the amount exceeds 40%, the resistance against sulfur attach of $SO_2$ gas and the like is deteriorated.

An amount of molybdenum is 0–10%, because when the amount exceeds 10%, the modifying ability of plasticity of the matrix metal is damaged and the crack susceptibility is enhanced.

An amount of manganese is 0–20%, because when the amount exceeds 20%, the creep rupture strength lowers and the oxidation resistance is deteriorated.

An amount of silicon is 0–5%, because when the amount exceeds 5%, the ductility is considerably damaged.

An amount of niobium, titanium, vanadium and zirconium is 0–5%, because when the amount exceeds 5%, an intermetallic compound is formed and the formed composite material becomes brittle.

An amount of aluminum is 0–10% and the addition of aluminum promotes the growth of crystal grain and the strength at a high temperature lowers.

An amount of iron is 0–40% and when the amount exceeds 40%, the creep rupture strength lowers and the oxidation resistance is deteriorated.

An amount of tantalum, hafnium, tungsten and rhenium is 0–15% and when the amount exceeds 20%, a high temperature is necessary for the formation of the composite material and the specific gravity becomes large and the merit of the composite material is lost.

An amount of calcium is 0–0.1% and when the amount exceeds 0.1%, the cleaning degree of the matrix metal is considerably deteriorated and the toughness becomes poor.

An amount of boron is 0–0.5% and when the amount exceeds 0.5%, the melting point considerably lowers and the eutectic is formed at the grain boundary and the strength and ductility at a high temperature are deteriorated.

Since carbon or nitrogen has a function which prevents the reaction of silicon carbide with cobalt, 0–1% of these elements may be advantageously added to metallic cobalt or cobalt alloy and when the said amount exceeds 1%, the composite material becomes brittle.

When 0–1% of beryllium is added and contained in the cobalt alloy, the relaxation property of the alloy at high temperatures is improved, so that this metal is effective as an element for reinforcing the metal matrix.

An addition of 0–2% of yttrium or rare earth metals is effective for improving oxidation resistance of cobalt alloy at high temperatures.

The tensile strength of the composite material becomes larger with increase of the volume fraction of the silicon carbide fibers in the composite material. Accordingly, the production of the composite material having a higher tensile strength needs increase of the volume fraction of the silicon carbide fibers added. However, when the amount of the silicon carbide fibers exceeds 80% by volume, the amount of the metal matrix is too small so that it is impossible to fill fully the spaces between the silicon carbide fibers with the metal matrix, accordingly it is impossible to develop the tensile strength in the formed composite material. When the amount of the fibers is less than 2%, the tensile strength of the composite material lowers, so that not less than 2% by volume of the silicon carbide fibers should be added in order to obtain the practically useful composite materials. Accordingly, in the production of the metal composite material reinforced with the silicon carbide fibers according to the present invention, the amount of the silicon carbide fibers to be added is 80–2% by volume and 2–60% by volume is preferred.

Then an explanation will be made with respect to a method for producing the composite materials of the present invention.

The silicon carbide fibers containing not less than 0.01% by weight of free carbon to be used in the present invention can be produced from the organosilicon compounds classified by the following groups (1)–(10).

(1) Compounds having only Si—C bond.
(2) Compounds having Si—H bond in addition to Si—C bond.
(3) Compounds having Si—Hal bond.
(4) Compounds having Si—N bond.
(5) Compounds having Si—OR bond (R: alkyl or aryl group)
(6) Compounds having Si—OH bond.
(7) Compounds having Si—Si bond.
(8) Compounds having Si—O—Si bond.
(9) Esters of organosilicon compounds, and
(10) Peroxides of organosilicon compounds.

At least one of the organosilicon compounds belonging to the above described groups (1)–(10) is subjected to polycondensation reaction by using at least one process of irradiation, heating and addition of polycondensing catalyst to form organosilicon high molecular weight compounds having silicon and carbon as the main skeleton components. For example, the compounds having the following molecular structures are produced.

(a)

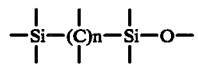

(b)

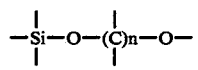

(c)

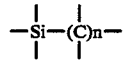

(d) The compounds having the above described skeleton components (a)–(c) as at least one partial structure in linear, ring and three dimensional structures or mixtures of the compounds having the above described skeleton components (a)–(c).

The compounds having the above described molecular structures are, for example, as follows.

(a)

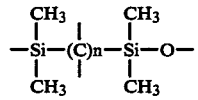

n=1, poly(silmethylenesiloxane),
n=2, poly(silethylenesiloxane),
n=6, poly(silphenylenesiloxane)

(b)

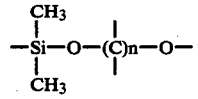

n=1, poly(methyleneoxysiloxane),
n=2, poly(ethyleneoxysiloxane),
n=6, poly(phenyleneoxysiloxane),
n=12, poly(diphenyleneoxysiloxane)

(c)

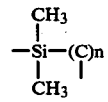

n=1, polysilmethylene,
n=2, polysilethylene (d) The compounds having the above described skeleton components as at least one partial structure in linear, ring and three dimensional structures or mixtures of the compounds having the above described skeleton components (a)–(c).

The above described organosilicon high molecular weight compounds are spun and the spun fibers are preliminarily heated under an oxidizing atmosphere and then baked at a high temperature of 1,000°–2,000° C. under at least one atmosphere of vacuum, inert gas, CO gas and hydrogen gas to form silicon carbide fibers having a very high strength and a high Young modulus.

The reason why the above described baking temperature is defined to be 1,000°–2,000° C. is as follows. At the temperature lower than 1,000° C., the silicon carbide crystal in the fiber is not fully grown and the strength and Young modulus of the fibers are small, while at the temperature higher than 2,000° C., the decomposition reaction of silicon carbide becomes violent.

The ratio of silicon and carbon contained in the organosilicon high molecular weight compounds (a)–(d), which are the starting material of the above described silicon carbide continuous fibers is at least 5 atoms of carbon based on 2 stoms of silicon, so that when the organosilicon high molecular weight compounds are spun and then baked, a major part of carbons bonding to the side chain of the high molecular weight compounds are converted into hydrocarbons, which are volatilized but 0.01%–30% by weight of free carbon can be remained in the silicon carbide fibers.

The structure of the cobalt composite material reinforced with the silicon carbide fibers according to the present invention is constituted by piling the silicon carbide fibers containing 0.01%–30% of free carbon and the spaces between the piled fibers are filled with a liquid or solid metal matrix to contact the fibers with the metal matrix and reacting the free carbon with the metal matrix. In the above described production method, if the silicon carbide fibers and the molten metal are contacted for a long time, the reaction of silicon carbide with cobalt, which has been retarded, progresses, so that the above described contacting time is preferred to be short and when such a contacting time is within 10 minutes, the free carbon in the fibers and the metal matrix react to improve the wettability of the fibers and the metal matrix, whereby the shear strength of the fibers and the metal becomes higher.

In order to form the composite material from the above described molten metal and the silicon carbide fibers, (1) infiltration process of the molten metal, (2) casting process and (3) diecasting process may be used. Among them, in the infiltration process of the molten metal, the molten metal is infiltrated between spaces in the fiber bundle, wherein the fibers are arranged in parallel, under vacuum or an inert gas atmosphere. In this case, it is advantageous to infiltrate the molten metal by evacuating one end of the fiber bundle and applying back-pressure to the molten metal with an inert gas.

In the casting process, it is advantageously possible to effect a continuous casting by filling the molten metal between the fibers as in the infiltrating process of the molten metal.

In the diecasting process, the mixture of the fibers and the molten metal is charged into a mold and press molded.

In order to form the composite material from the solid state of metal matrix and the silicon carbide fibers, by the diffusion bonding process wherein the above described metal and the fibers are contacted and subjected to hot pressing, the free carbon and the metal can be reacted to form the composite material having a good bonding ability of the above described metal matrix to the fibers.

In order to produce the composite materials by the above described diffusion bonding process through hot press, (1) foil metallurgy process, (2) powder metallurgy process, (3) electro-deposition process, (4) plasma spray process and (5) vapor deposition process may be used.

In the foil metallurgy process, the metallic foil and the fibers are wound in a drum-shape while fixing them by an organic binder to form a layer wherein the foil and the fibers are piled one on the other and the layer is taken off from the drum and cut into a proper shape and the cut layers are subjected to hot press.

In the powder metallurgy process, the powder metal and the fiber layer are piled alternately and charged in a mold, or one end of the fiber bundle is evacuated to fill spaces in the fiber bundle with the powder metal to form a given shape, or the short fibers and the powder metal are rolled or extruded to form a molding and then the resulting mold is subjected to hot press.

In the electro-deposition process, the metal matrix is deposited on the fibers by electro-deposition into a desired shape and then the metal deposited fibers are subjected to hot press.

In the plasma spray process, the powder metal is jetted into plasma arc under an inert atmosphere and the jetted powder metal is sprayed and deposited on the arranged fibers and the metal deposited fibers are subjected to hot press.

In the vapor deposition process, the metal is deposited on the surface of the fibers by vacuum vapor deposition or chemical vapor deposition and the metal deposited fibers are bundled and the resulting bundle is subjected to hot press.

In the above described hot press process, the temperature range in the hot press is preferred to be from 700° C. to the melting point of the metal. When the temperature is lower than 700° C., the reaction of the free carbon with the metal is very slow and is not practical, while at the temperature higher than the melting point of the metal, the metal melts, so that the best result can be obtained within the temperature range of from 700° C. to the melting point of the metal. However, it is possible to effect hot press under semi-melted state of the metal.

The pressure during hot pressing is 0.001–20 t/cm$^2$ and when the pressure is lower than 0.001 t/cm$^2$, the pressure effect is not obtained, while even if the pressure is higher than 20 t/cm$^2$, the effect is not improved, so that the pressure should be 0.001–20 t/cm$^2$.

In order for the free carbon to react with the metal by the above described hot press, the good result can be obtained by effecting the hot press for a long time and in general, the best result can be obtained in the time of more than 10 minutes at a temperature of higher than 1,400° C., in the time of more than 16 minutes at a temperature higher than 1,300° C., in the time of more than 38 minutes at a temperature higher than 1,200° C., in the time of 85 minutes at a temperature higher than 1,100° C., in the time of more than 200 minutes at a temperature higher than 1,000° C., in the time of more than 350 minutes at a temperature higher than 900° C. and in the time of 600 minutes at a temperature of 800° C.

The following examples are given for the purpose of illustration of this invention and are not intended as limitations thereof. In the examples, "%" and "parts" mean by weight unless otherwise indicated.

EXAMPLE 1

A cobalt alloy consisting of 42.0% of cobalt, 19.0% of chromium, 20.5% of nickel, 3.9% of molybdenum, 4.2% of tungsten, 4.0% of niobium, 0.35% of carbon, 1.1% of manganese and the remainder being iron was melt in a chamber kept under argon atmosphere. Silicon carbide fibers containing 10% of free carbon were arranged in parallel in an alumina pipe of 20 mm diameter, both ends of which were open. One end of the tube was sealed and the other end was connected to a vacuum system. The interior of the tube was evacuated under heating to degas the fibers, and then the tube was introduced into the above described argon gas chamber. The above described sealing of the alumina tube was removed in the argon gas chamber, and the open end of tube was immersed into the above described melt cobalt alloy bath, and the interior of the tube was made vacuum to infiltrate the melt cobalt alloy between the fibers. The melt state of the cobalt alloy was maintained for 5 minutes to obtain a cobalt alloy composite material reinforced with the silicon carbide fibers. The resulting composite material contained 24% by volume of the fiber and had a tensile strength of 146 kg/mm$^2$, which was about 1.5 times as high as that of a cobalt alloy having substantially the same composition as that of the cobalt alloy used in this Example 1. Accordingly, it can be seen that the cobalt alloy is reinforced with the silicon carbide fibers.

EXAMPLE 2

Metallic cobalt and silicon carbide fibers containing 8% of free carbon were used. In the same manner as described in Example 1, melt cobalt was introduced into an alumina tube and the melt state of the cobalt was maintained for 1 minutes to obtain a cobalt composite material reinforced with the silicon carbide fibers. The cobalt composite material contained 29% by volume of the fiber and had a tensile strength of 69 kg/mm$^2$, which was about 3.0 times as high as that of metal cobalt. Accordingly, it can be seen that the metallic cobalt is reinforced with the silicon carbide fibers.

EXAMPLE 3

A powder mixture consisting of 100 parts of a cobalt alloy powder, which consists of 50.1% of cobalt, 28.2% of chromium, 20.5% of iron, 0.10% of carbon, 0.72% of manganese, 0.25% of silicon, and 0.8 part of lithium stearate as a lubricant, and silicon carbide fibers containing 5% of free carbon were used. The silicon carbide fibers were piled in parallel in a mold having a dimension of 20mm×20mm×100mm, and spaces between the piled fibers were filled with the powder mixture, and the resulting body was compacted. The resulting body was preliminarily heated at 450° C. for 2 hours under hydrogen gas atmosphere, and then hot pressed at 900° C. for 2 hours under a pressure of 0.1 t/cm$^2$ under argon gas atmosphere to obtain a cobalt alloy composite material reinforced with the silicon carbide fibers. The resulting composite material contained 29% by volume of the fibers and had a tensile strength of 141 kg/mm$^2$. This tensile strength was about 1.5 times as high as the tensile strength, 91 kg/mm$^2$, of a forged cobalt alloy having substantially the same composition as that of the above described cobalt alloy powder. Accordingly, it can be seen that the cobalt alloy is reinforced with the silicon carbide fibers.

EXAMPLE 4

To 100 parts of a cobalt alloy powder consisting of 40.5% of cobalt, 19.0% of chromium, 15.2% of nickel, 2.0% of manganese, 7.9% of molybdenum, 15.1% of iron, 0.16% of carbon, 0.04% of beryllium and 0.1% of silicon was added 1.2 parts of zinc stearate as a lubricant, and the resulting powder mixture was used as a matrix for a composite material. Silicon carbide fibers containing 6% of free carbon were piled in parallel in a mold of 30mm×30mm×100mm, and the spaces between the fibers were filled with the powder mixture. The resulting mass was compacted to obtain a green body. The resulting body was preliminarily heated at 400° C. under hydrogen gas atmosphere, and then hot pressed at 950° C. for 1.5 hours under a pressure of 2 t/cm$^2$ under argon gas atmosphere to obtain a cobalt alloy composite material reinforced with the silicon carbide fibers. The resulting composite alloy contained 28% by volume of the fibers and had a tensile strength of 146 kg/mm$^2$. This tensile strength was about 1.5 times as high as that of a cobalt alloy having substantially the same composition as that of the above described cobalt alloy powder. Accordingly, it can be seen that the cobalt alloy is reinforced with the silicon carbide fibers.

EXAMPLE 5

Figure 8:
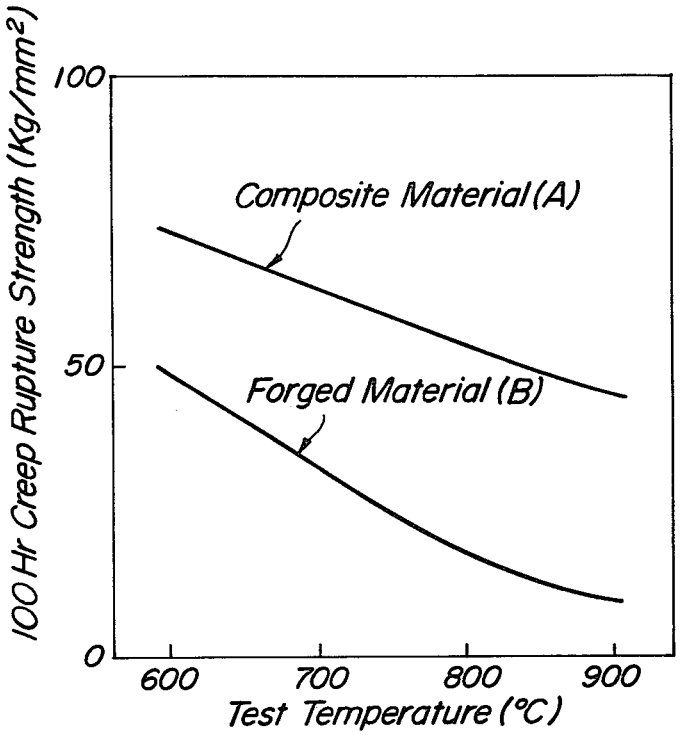
FIG. 8 is a graphical representation showing a relation between the creep rupture strength of the cobalt composite material reinforced with the silicon carbide fibers containing 4% by weight of free carbon and the test temperature.

A cobalt alloy consisting of 43.1% of cobalt, 20.1% of chromium, 19.5% of nickel, 4.0% of tungsten, 3.9% of niobium, 4.3% of molybdenum, 1.2% of manganese, 0.2% of silicon, 0.35% of carbon and 4.2% of iron was applied to silicon carbide fibers containing 4% of free carbon by a plasma spray method. Bundles of the coated silicon carbide fibers were arranged in a mold of 20mm×20mm×100mm and hot pressed at 1,100° C. for 3 hours under a pressure of 0.1 t/cm$^2$ under argon gas atmosphere to obtain a composite material. The composite material contained 25.2% by volume of the fibers. It can be seen from FIG. 8 that the creep rupture strength (FIG. 8A) at 600°-800° C. of the resulting composite material is remarkably higher than that (FIG. 8B) of a forged cobalt alloy having the same composition as that of the cobalt alloy powder used in the production of the above described composite material, that is, the cobalt alloy is reinforced with the silicon carbide fibers.

As described above, the cobalt or cobalt alloy composite materials reinforced with continuous silicon carbide fibers, obtained by the method of the present invention, are very high in the tensile strength and are high in the Young modulus, heat resistance and wear resistance. Therefore, the composite materials can be used widely as high-strength heat resistant materials, such as vanes and blades for gas turbine, nozzles, jigs for heat treatment, heat resistant springs and so on, and further can be advantageously used as materials for apparatus for producing synthetic fibers, materials for apparatus for synthetic chemistry, mechanical industrial materials, materials for domestic and office supplies, materials for constructing machine, fire protecting materials, marine materials, automobile materials, materials for apparatus for producing food, sport materials, ship and aircraft materials, electrical materials, agricultural materials, fishing implements, atomic implements, nuclear fusion furnace material, sun heat utilizing material, medical instruments and so on.

What is claimed is:

1. Cobalt or cobalt alloy composite materials reinforced with continuous silicon carbide fibers having excellent tensile strength and Young modulus, in which the wettability of metallic cobalt or cobalt alloy and the silicon carbide fibers is improved by combining 20–98% by volume the cobalt metal matrix and 80–2% by volume of silicon carbide fibers containing 0.01%–30% by weight of free carbon obtained by baking spun fibers consisting mainly of an organosilicon high molecular weight compound.

2. Cobalt alloy composite materials reinforced with continuous silicon carbide fibers having excellent tensile strength and Young modulus, in which the wettability of cobalt alloy and the silicon carbide fibers is improved by combining the cobalt alloy containing at least one of chromium, nickel, molybdenum, manganese, silicon, niobium, titanium, aluminum, iron, tungsten, vanadium, tantalum, zirconium, hafnium, calcium, boron, rhenium and uranium, which readily react with free carbon to form the carbides with the silicon carbide fibers containing 0.01%–30% by weight of free carbon obtained by baking spun fibers consisting mainly of an organosilicon high molecular weight compound.

* * * * *